United States Patent [19]

Fischer et al.

[11] 3,998,688

[45] Dec. 21, 1976

[54] METHOD FOR THE PRODUCTION OF CELLULOSE FIBERS USING A TWO-STEP PRE-TREATMENT

[75] Inventors: Klaus Fischer, Wolfen; Josef Ringel, Dessau, both of Germany

[73] Assignee: VEB Filmfabrik Wolfen, Wolfen, Germany

[22] Filed: Sept. 4, 1974

[21] Appl. No.: 503,192

[52] U.S. Cl. ..... 162/50; 162/83; 162/86

[51] Int. Cl.[2] ..... D21C 1/00; D21C 1/06

[58] Field of Search ..... 162/50, 86, 83

[56] References Cited

UNITED STATES PATENTS

| | | | |
|---|---|---|---|
| 3,801,432 | 4/1974 | Free | 162/50 |
| 3,830,689 | 8/1974 | Rautalahti et al. | 162/86 |

FOREIGN PATENTS OR APPLICATIONS

| | | | |
|---|---|---|---|
| 78,689 | 12/1970 | Germany | 162/86 |
| 317,139 | 12/1956 | Switzerland | 162/50 |

OTHER PUBLICATIONS

Rhydholm; *Pulping Processes* p. 849 Interscience Publishers, 1965.

*Primary Examiner*—S. Leon Bashore
*Assistant Examiner*—Steve Alvo
*Attorney, Agent, or Firm*—Nolte and Nolte

[57] ABSTRACT

A process for the preparation of cellulose fibers from cellulose containing chips wherein the cellulose containing chips are subjected to a chemical process for the purpose of separating the cellulose from lignin and other extraneous chemicals which prior to digestion of the chips subjecting the chips to a two-step pre-treatment by:

1. contacting said chips with an aqueous solution of an alkali metal, alkaline earth metal or ammonium sulfite or bi-sulfite metal; and,
2. thereafter radiating the so pre-treated chips by contacting them with charged particles.

17 Claims, No Drawings

METHOD FOR THE PRODUCTION OF CELLULOSE FIBERS USING A TWO-STEP PRE-TREATMENT

BACKGROUND OF THE INVENTION

This invention relates to a method for the production of cellulose and particularly to a method for the production of cellulose which can be used in paper-making and in textiles. More specifically, this invention relates to a pre-treatment of wood chips prior to a digestion process whereby the digestion process can be carried out economically, the cellulose fibers do not require extensive bleaching with bleaching agents and the cellulose polymeric chain is reduced in size whereby the digestion process can be carried out more efficiently. This invention is also directed to a process of pre-treatment of such cellulose containing chips whereby the following digestion process can be accelerated and the resultant cellulose is obtained in improved yield and has improved strength properties.

It is known in the preparation of cellulose fibers for use in paper-making to subject a naturally occuring material containing cellulose, e.g., wood chips to a full chemical or semi-chemical process for the purpose of separating the cellulose fibers therein from other naturally occuring components. In such chemical process, the wood chips are cooked with suitable chemicals in an aqueous solution, usually at elevated temperatures and pressures. The object is to dissolve the naturally occuring lignin and other extraneous compounds, leaving the cellulose intact and in fibrous form. The objective can be realized to a commercially satisfactory degree.

It is known to utilize, in such a digestion process, sulfites or sulfates. Both methods suffer from the disadvantage that the lignin content in the unbleached cellulose, as a function of the required processing properties, cannot be decreased below a certain level. Because of this, the unbleached cellulose has a low degree of whiteness. In the production of bleached cellulose, the relatively high use of bleaching chemicals to improve the whiteness properties of the unbleached cellulose in turn causes damage to the cellulose fiber itself and impairs the cellulose's ability to withstand certain processing.

It is known according to West German Offenlegenschrift No. 2,208,335 to pre-treat the wood chips by irradiation with charged particles. The purpose of this pre-treatment is to improve the yield and strength of the cellulose for use in papermaking. When the chips are irradiated with high energy particles, however, structural alterations occur at the macro-molecules of the lignin. This structural alteration makes elution of this substance far more difficult owing to the fact that a lignin condensation during the digestion process occurs. This lignin condensation effects a higher lignin content in the unbleached cellulose. This disadvantage in increased lignin content in the unbleached cellulose in turn requires the use of still higher amounts of bleach chemicals during the bleaching process. The use of such higher amounts of chemicals in turn lowers the strength of the cellulose. The effect of increased cellulose strength which is the purpose behind the irradiation is thereby eliminated at least in part by the subsequent bleaching operation. When unbleached cellulose produced by this method is used for paper-making, the whiteness of the end product is reduced.

It is also known according to East German WP No. 78,689, issued December 20, 1970, that the pre-treatment of wood chips with aqueous bi-sulfite or sulfite solutions of an alkali metal, alkaline earth metal or ammonium or mixtures of such solutions can be performed to reduce the disadvantageous alterations of lignin during the storage of the chips prior to digestion. By this method, the alterations of the lignin during exposed storage of the chips can be prevented. However, while the lignin does not undergo the condensation referred to above, the lignin content in the unbleached cellulose still cannot be lowered below those levels typically encountered in the known sulfite digestion processes.

It has, therefore, become desirable to provide a process for the pre-treatment of cellulosic containing chips or other materials whereby the lignin in the unbleached cellulose following digestion is reduced. More specifically, it has become desirable to provide a process for the pretreatment of such naturally occuring materials, prior to a digestion process, whereby during the digestion process, the lignin does not undergo a lignin condensation. Stated in the positive, it has become desirable to provide a pretreatment process whereby the finally-produced unbleached cellulose has improved strength properties and improved whiteness. It has also become desirable to provide such a process which enables the bleaching process to be carried out with far less chemicals whereby to preserve the processing characteristics of the cellulose fibers.

SUMMARY OF THE INVENTION

The objects of the present invention are provided by an improvement in a process for the preparation of cellulose fibers from cellulose containing solids wherein the cellulose containing solids are subjected to a chemical process for the purpose of separating the cellulose from lignin and other extraneous chemicals, the improvement residing in subjecting said solids:

1. to a pre-treatment by contacting said solids with an aqueous solution of an alkali metal, alkaline earth metal or ammonium sulfite or bi-sulfite solution; and,
2. irradiating the so pre-treated solids by contacting them with charged particles.

In accordance with the present invention, it has been found that the lignin content of the unbleached cellulose is lowered far beyond those levels typically found in the known digestion processes by a suitable pre-treatment of the naturally occuring cellulose solids. In such connection, the term "solids" refers to any number of physical forms in which the naturally occuring cellulose can be found including regular as well as irregularly shaped particles of numerous and various dimensions. Typically, they are in the form of wood chips although larger particles can be employed. The precise form of the cellulose containing solid is not particularly critical although it is desired that the same have a large surfaced area as pre-treatment with the aqueous solution and subsequent irradiation thereof are best performed on a material having a large surface area.

The pre-treatment is accomplished by an initial contact of the cellulose containing material with an aqueous solution of an alkali, alkaline earth metal, or ammonium sulfite or bi-sulfite which initial treatment is followed by irradiation of the solid material with charged particles, preferably high energy electrons. By pre-treating the chips in such a manner with aqueous sulfite or bi-sulfite solutions of alkali metals, alkaline earth metals or ammonium or mixtures thereof, the advantages obtained by irradiation with charged particles with radiation dosages can be realized. This initial aqueous salt solution treatment effects a shortening of the polymeric chain of the cellulose itself. Hence, the digestion process itself can be reduced without disadvantageous alterations of the lignin. This is due especially to the pre-treatment with the salt solutions whereby the tendencies of the lignin to undergo condensation at the lignin macro-molecules is materially reduced.

While not wishing to be bound by any theory, it is believed that the treatment with aqueous bi-sulfite or sulfite solutions effects a blocking of the lignin whereby the lignin is prevented during digestion from undergoing any substantial condensation. This permits a considerable reduction of the lignin content in the unbleached cellulose obtained upon digestion.

The present process is suitably performed on cellulose containing chips by contacting the chips with an aqueous sulfite or bi-sulfite solution, as described above, thereafter the chips are subjected to storage. Following storage, they can then be irradiated as described whence the material can be introduced into a digestion process.

The method is particularly suitable for the production of textile cellulose in which prior to the digestion there is effected a pre-treatment consisting of, first, treatment of the chips with aqueous bi-sulfite or sulfite solution of alkali metal, or alkaline earth metal or ammonium or mixtures thereof and, then, irradiation of the so-treated chips with charged particles, preferably high-energy electrons.

With respect to the solutions, it is particularly contemplated, in the case of an alkali metal sulfite or bi-sulfite solution that the alkali metal be sodium, potassium or lithium. In the case of the use of an alkaline earth metal sulfite or bi-sulfite, it is particularly contemplated to use a sulfite or bi-sulfite of barium, calcium or magnesium. Of course, ammonium sulfite and bi-sulfite aqueous solutions are particularly contemplated.

These solutions generally have a concentration of sulfite or bi-sulfite of between 1 and 10 percent, preferably between 4 and 6 weight percent. The pre-treatment is suitably carried out at a temperature between 10° and 60° C, preferably between 10° and 30 ° C, with room temperature being most preferred. The duration of the treatment depends upon several factors, including the size of the wood chips undergoing treatment. Generally speaking, the pretreatment is carried out for a period of between 0.5 and 60 minutes, preferably between 0.5 and 5 minutes, depending of course upon the strength of the solution.

While treatment of the wood chips following contact with the sulfite or bi-sulfite solution can be performed by subjecting the so pre-treated material to many forms of radiation, it is preferred to subject such material for a period of betweem 0.001 and 3 minutes, preferably between 0.01 and 0.5 minutes to electrons at a radiation dosage of between 0.1 and 1.0 megarads, preferably between 0.1 and 0.5 megarads. This can be performed using a source of electron irradiation having an anode potential between 200 and 1500 kV and a current between 0.3 and 30 mA.

A principal advantage of the invention is the reduction of the lignin content in the unbleached cellulose obtained upon the digestion process. This unbleached cellulose is characterized by a higher degree of whiteness which saves a considerable amount of money in the bleaching of the unbleached cellulose whereby fewer bleach chemicals or chemicals of lower concentration are required. By subjecting the naturally occuring material to the aforesaid double-step pre-treatment, the polymeric chain of the cellulose is shortened. Due to this feature, the digestion process can be accelerated and thereby the productivity and effectiveness of the entire overall cellulose production is increased. The low amount of bleach chemicals used, caused by the reduction of the lignin content in the unbleached cellulose, largely prevents damage to the cellulose and provides an improvement in the quality of the bleached cellulose. The advantages in improving yield by the irradiation process can be fully realized without impairing the cellulose particles or fibers themselves.

A typical preferred embodiment of the present invention is set forth in the example below:

EXAMPLE

Debarked and sorted beech chips were treated with an aqueous calcium bi-sulfite solution having a calcium content, calculated as calcium oxide, of 1.9% and a total $SO_2$ content of 6.0 weight percent. The pretreated chips were subjected to electron irradiation from an anode having an anode potential of 1,000 kV. The current strength was 20 mA. The applied radiation dosage was 0.5 megarad.

Following the two-step pre-treatment process, the material was subjected to a digestion process carried out by use of calcium bi-sulfite. In this step, the so treated materials were contacted with a boiling acid which contained 6.0% by weight total $SO_2$ and 0.98 weight percent CaO. After a dwell time of two hours at 110° C, the material was heated to 133° C at which point boiling off of liquids occured providing a viscosity of 30 cP. The dwell time at 133° C, denominated "boil-off" time, was 3.0 hours. The cellulose obtained therefrom was unbleached. It was subjected to a test to determine its permanganate number. The permanganate number of the unbleached material was 10.

In another experiment, the digestion was carried out for purposes of comparison wherein the chips were not pretreated with calcium bi-sulfite solution and were not irradiated. The permanganate number of the unbleached cellulose following digestion was 20 even though digestion was carried out in the same manner with a boil-off time of 4 hours. Such demonstrates that not only does the pre-treatment provide an improved unbleached cellulose, but that pre-treatment materially reduces, by at least 25%, the time required for the digestion establishing itself.

What is claimed is:

1. In the process for the preparation of cellulose fibers from cellulose containing solids wherein the cellulose containing solids are subjected to a chemical digestion for the purpose of separating the cellulose from lignin and other extraneous chemicals, the improvement which comprises prior to digestion of said solids subjecting said solids to a two-step pre-treatment by:

1. in a first step contacting said solids with an aqueous solution of sodium, potassium, lithium, calcium, barium, magnesium or ammonium sulfite or bisulfite and mixtures thereof for 0.5 to 60 minutes at temperatures of 10° to 60° C., and 2. in a second step irradiating the first step pre-treated solids by contacting them with charged particles, whereby the solids which are the product of said pre-treatment yield a pulp of lower lignin content and increased whiteness after the solids have been digested than cellulose containing solids without said pre-treatment.

2. A process according to claim 1 wherein the charged particles are high energy electrons.

3. A process according to claim 2 wherein the cellulose solids are wood chips, the wood chips are pre-treated according to Step 1 and stored and after storage, are thereafter irradiated as in Step 2.

4. A process according to claim 2 wherein the irradiation is of a dosage between 0.1 and 1.0 megarad and the solids are irradiated for a period of time between 0.001 and 3 minutes.

5. A process according to claim 4 further comprising digesting the pre-treated cellulose containing solids to produce unbleached cellulose and bleaching the unbleached cellulose.

6. A process according to claim 4 wherein the aqueous sulfite or bi-sulfite solution has a concentration of sulfite or bi-sulfite compound therein of between 1 and 10 weight percent.

7. A process according to claim 6, further comprising digesting the pre-treated cellulose containing solids to produce unbleached cellulose and bleaching the unbleached cellulose.

8. A process according to claim 1, in which the irradiation is with electrons from a source of electron irradiation having an anode potential of from 200 to 1500 kilovolts and a current of from 0.3 to 30 milliamperes.

9. A process according to claim 8, in which the cellulose containing solids are wood chips.

10. A process according to claim 9, in which the wood is beech.

11. A process according to claim 8, further comprising digesting the pre-treated cellulose containing solids to produce unbleached cellulose and bleaching the unbleached cellulose.

12. A process according to claim 11, in which the cellulose containing solids are wood chips.

13. A process according to claim 12, in which the wood is beech.

14. A process according to claim 13, in which the first step of the pre-treatment is conducted with an aqueous solution of calcium bisulfite.

15. A process according to claim 14, in which the digestion is conducted with a boiling acidic solution of calcium bisulfite.

16. A process according to claim 1 wherein the cellulose containing solids are in the form of wood chips.

17. A process according to claim 1, further comprising digesting the pre-treated cellulose containing solids to produce unbleached cellulose and bleaching the unbleached cellulose.

* * * * *